US005717151A

United States Patent [19]

Straubinger

[11] Patent Number: 5,717,151

[45] Date of Patent: Feb. 10, 1998

[54] PAD ADJUSTING DISK AND METHOD FOR ALIGNING A PAD ASSEMBLY

[76] Inventor: David J. Straubinger, 2521 E. Southport Rd., Indianapolis, Ind. 46227

[21] Appl. No.: 328,686

[22] Filed: Oct. 25, 1994

[51] Int. Cl.[6] ..... G10D 7/08

[52] U.S. Cl. ..... 84/385 P

[58] Field of Search ..... 84/385 P

[56] References Cited

U.S. PATENT DOCUMENTS

| | | | |
|---|---|---|---|
| 3,688,633 | 9/1972 | Nagao | 84/380 |
| 4,704,939 | 11/1987 | Staubinger | 84/385 |
| 4,798,122 | 1/1989 | Gisler et al. | 84/385 P |
| 5,297,466 | 3/1994 | Wasser | 84/385 |
| 5,339,719 | 8/1994 | Wasser | 84/385 |
| 5,381,718 | 1/1995 | Wasser | 84/385 P |

*Primary Examiner*—Cassandra C. Spyrou
*Attorney, Agent, or Firm*—Edward E. Sowers

[57] ABSTRACT

Novel stabilizing and adjusting disks are described in addition to a method utilizing the disks for aligning or seating the pad assembly of a woodwind instrument within its pad cup. The novel disks have flexible outer regions which can be made to conform to the contour of a tone hole surface or interface by applying an appropriate force against the stabilizing and adjusting disk combination. The stabilizing disk is held within the pad cup in an adjusted position by an adhesive or other material capable of being transformed from a liquid to a solid under the conditions utilized for adjustment of the pad assembly. Examples illustrate the method utilizing forces derived from magnetic fields and pressure differentials to cause the stabilizing and adjusting disks to conform to the tone hole surface. After adjustment, the adjusting disk is replaced with a pad assembly having an appropriate thickness.

12 Claims, 7 Drawing Sheets

PAD ADJUSTING DISK AND METHOD FOR ALIGNING A PAD ASSEMBLY

BACKGROUND

Figure 1:
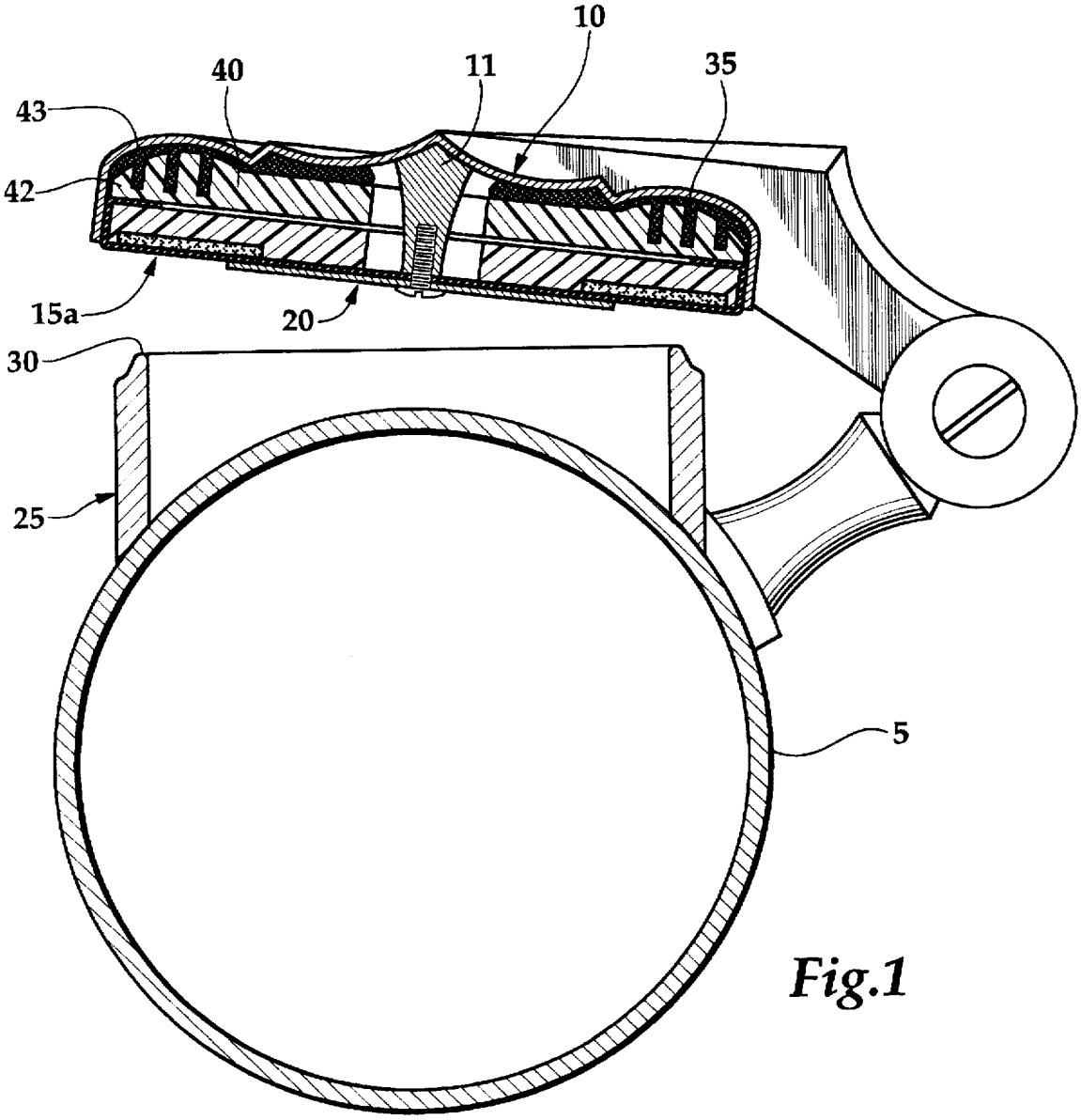

This invention relates generally to stabilizing and adjusting disks useful for adjusting or aligning the pad assembly of a flute to cause the instrument's pad surface to conform to the tone hole's surface and a method for using the two disks to carry out the adjusting process.

Pads for flutes have typically comprised cardboard backed wool felt disks covered with Goldbeater's skin wrapped around the cardboard and glued to its backside. The pad is generally planar and fixed in a pad cup, sealing side exposed. The pad is held in the pad cup with washer and screw combination fastened to a pad nut centrally located within the pad cup, with a grommet or with an adhesive. The pad cup and pad combination are mounted over an instrument tone hole on a hinged mechanism so that the tone hole is sealed when the pad is in its closed position. The inability of the tone hole to close tightly with minimal pressure adversely affects the instrument's tone and the player's technique. An instrument only 0.001 of an inch out of adjustment produces an air leak detectable by the player. Although the player can usually compensate for small air leaks by applying more pressure against the pad, technique suffers. When leaks are more severer the player cannot compensate and as a result, both tone and response suffer. Pad adjustment or alignment is required when a flute is manufactured and subsequently when air leaks develop at the pad/tone hole interface. Such leaks subsequent to manufacture generally result from misalignment caused by movement of the pad cup in relation to the tone hole, changes in the tone hole surface, changes in the pad's surface, or a combination of these factors.

Pad alignment involves either moving the entire pad surface closer to the tone hole, tilting the pad cup, tilting the pad within the pad cups deforming the pad surface, therefore causing the pad to become non-planar in order to conform to a non-planar tone hole surface. Usually more than one form of adjustment is required. The extent and nature of pad alignment depends on whether the instrument is a less expensive student's flute or a more expensive handmade flute.

One procedure commonly used for pad alignment on a student's flute involves deformation of the pad's surface at elevated temperatures. The procedure involves clamping the pad in the closed position and placing the instrument in an oven at elevated temperature for several minutes to conform the pad's surface to the tone hole surface. Although the adjusting process can be accomplished quickly to produce a good initial seal, normal usage and changes in temperature and humidity cause the felt to lose its shape resulting in air leaks.

Deformation of the pad surface at elevated temperature also produces a depression or seat in the pad surface which stretches the pad causing unwanted noise when the pad opens. The noise results from the pad's surface sticking to the tone hole as the pad begins to open. Initially the stretched pad surface remains in contact with the tone hole's surface, but upon further opening is released causing a perceptible noise. Formation of the seat can be minimized if the deformation process is carried out by ironing the pad with a thin piece of heated metal placed between the tone hole and the pad's surface. However, as before, the felt surface does not hold its shape during normal usage of the instrument making further adjustment necessary.

Because the pad cups in a handmade instrument are smaller than in the student flute and overlap the tone hole less, more time and effort must be spent to locate and eliminate air leaks at the pad/tone hole interface. Air leaks can be located by placing a light at the end of the flute body and lightly depressing the pad against the tone hole. Light reflection against the inside tone hole surface will make leaks visible while no light showing at the tone hole interface indicates a good seal. Alternatively, air leaks can be detected by placing a feeler gauge over the tone hole, lightly depressing the pad to close the tone hole and gently pulling on the gauge. Resistance on the gauge when pulled indicates a good seal in the region being checked while lack of resistance on the gauge indicates a leak. The magnitude of the leak can be determined by varying the thickness of the feeler gauge in successive determinations or visually using the light. By repeating the process across the entire tone hole interfaces a map of air leaks and their magnitude can be created. Once located, air leaks are eliminated by removing the pad from the pad cup, installing paper shims of the appropriate thickness where needed and replacing the pad within the cup. After installation of the shims, the instrument is again checked for remaining air leaks and additional shims are added as necessary. This process of locating air leaks and adding paper shims is repeated until no air leaks are detected. The process is tedious and expensive, often requiring 15 to 20 hours of labor to align all of the pads in a handmade flute.

A method is described in U.S. Pat. No. 5,297,466 for seating the pads of a woodwind instrument quickly and without requiring the skill and experience needed for the prior art methods. The method utilizes a magnetically attractable pad having a metal washer either placed within the pad or located at the back side of the pad to tilt or pivot the pad within the pad cup without distorting the pad from its original planar conformation. The adjustment is accomplished by applying a magnetic force to the magnetically attractable pad from within the instrument body under the pad being adjusted. The downward force created by the magnet compresses the pad into the tone hole seat and while the pad is in a compressed position, the glue placed behind the pad is allowed to cure or a hot melt glue similarly placed is heated and allowed to cool. The amount of compression experienced by the pad's felt will depend on the strength of the magnetic force used for the adjustment. Because the compression is temporary, the felt will gradually return to its original position and as a result, upon closing, the pad will hit the tone hole surface closest to the hinge position of the key. In order to completely seal the tone hole, additional pressure will be required. If heat is used on the pad surface during the adjustment, the pad's skin surface can become permanently stretched causing it to remain momentarily attached to the tone hole surface as the pad is released causing unwanted noise.

None of the commonly used methods for aligning the pad over the tone hole can be carried out quickly and at a low cost to provide an accurate and long lasting seal which can be formed without unwanted noise. The methods employed are a compromise between performance required of the instrument and the amount of labor required to align the pads. A method is needed which will allow a flute's pad assembly to be aligned quickly, inexpensively and simply to provide a good seal without the production of unwanted noise, regardless of whether the flute is a less expensive student's flute or a more expensive handmade flute.

SUMMARY

As will become apparent from the following discussion, this invention provides for novel stabilizing and adjusting disks and a method utilizing the novel disks to quickly and simply align a flute pad during manufacture or during subsequent replacement of a pad assembly. Alignment can be accomplished quickly regardless of whether the tone hole surface is planar or non-planar, requires minimal labor, and avoids the formation of an unwanted depression or seat on the pad's surface in the region contacted by the tone hole. Use of the method can provide a long lasting seal at the pad/tone hole interface which produces a minimum of noise when the pad opens and closes and doesn't foreclose the option of further adjustments made by placing paper shims between the stabilizing disk and the pad assembly.

The pad cup and pad assembly utilized include, within the pad cup, a layer of an adjusting agent, a stabilizing disk in contact with the adjusting agent, and a pad assembly. The adjusting agent can be a conventional adhesive or other material capable of being first a liquid then a solid. The stabilizing disk is a washer shaped disk made of metal, a polymer, or a combination of materials having an outer region sufficiently flexible to allow the disk to distort and conform to the contour of a non-planar tone hole surface and further having at least one generally planar surface. One preferred embodiment of the stabilizing disk has at least some magnetically attracting properties. The stabilizing disk is positioned within the pad cup by an adjusting agent capable of first flowing during the alignment process while the disk is conforming to the tone hole and subsequently solidifying to maintain the stabilizing disk in its newly aligned position. The pad assembly can be constructed of a cardboard backed wool felt disk covered by Goldbeater's skin or similar material. However, because a pad of uniform thickness is required to obtain maximum benefit from the adjustment, a preferred pad assembly is described in U.S. Pat. No. 47704,939, the disclosure of which is hereby incorporated by reference. That pad is constructed by stretching a skin across a cushion ring fitted within a recess on the lower radial face of a rigid backing disk having a bendable and flexible lower margin. The skin is folded around the edge of the backing disk and secured to the disk's back side. The pad assembly for a closed hole pad is held within the pad cup by a washer and screw combination wherein the screw is fastened to the pad nut located within the central region of the pad cup. For the open hole pads, a grommet is used to retain the pads.

The adjusting disk is a generally planar disk of uniform thickness capable of distorting to become non-planar and having at least one surface sufficiently firm to resist deformation when pressed against the tone hole surface. The adjusting disk can be constructed of metal, polymers, or a combination of these materials. One preferred embodiment of the adjusting disk has a non-porous central region, an intermediate porous region, and an outer non-porous region. When placed within a pad cup containing a stabilizing disk, both non-porous regions of the adjusting disk's first side are capable of fitting flush with the surface of the planar second side of the stabilizing disk and forming a seal. The second side of the adjusting disk in the region of contact with the tone hole interface is capable of forming a seal with the tone hole and is sufficiently firm to resist significant surface compression when pressed against the tone hole.

The alignment process utilizes stabilizing and adjusting disks, both sufficiently flexible to conform to the tone hole's surface, whether that surface is planar or non-planar. Sufficient flexibility can be achieved by controlling the thickness of the disks or by locating circular grooves on one or more of the disk's surfaces intermediate or near the disk's circumference. The process comprises the steps of placing the adjusting agent and the stabilizing disk within the pad cup and inserting an adjusting disk so that it comes in contact with the stabilizing disk either before or after attaching the pad cup assembly to the woodwind instrument. While the adjusting agent is maintained in a fluid state, slight pressure, sufficient to close the tone hole, is applied to the pad cup assembly and maintained. At the same time, a force, subsequently referred as a "downward force", is exerted on the stabilizing/adjusting disk combination in the direction of the tone hole, to conform both disks to the contour of the tone hole interface. The downward force can be either a magnetic force emanating from within the instrument or result from a pressure differential resulting from the creation of a vacuum within the instrument and within a cavity between the stabilizing disk and the adjusting disk. The two disks are held in place by the downward force until the adjusting agent has solidified locking the two disks into an aligned position. The alignment is concluded by eliminating the downward force, releasing pressure on the pad cup assembly, removing the adjusting disk and replacing it with a pad assembly having an appropriate uniform thickness and lacking any temporary compression in its surface.

DRAWINGS

These and other features, aspects, and advantages of this invention will become better understood with regard to the following description, appended claims and accompanying drawings where:

FIG. 1 shows a sectional view of a flute illustrating the relationship between the tone hole, pad cup, and pad assembly.

Figure 2A:
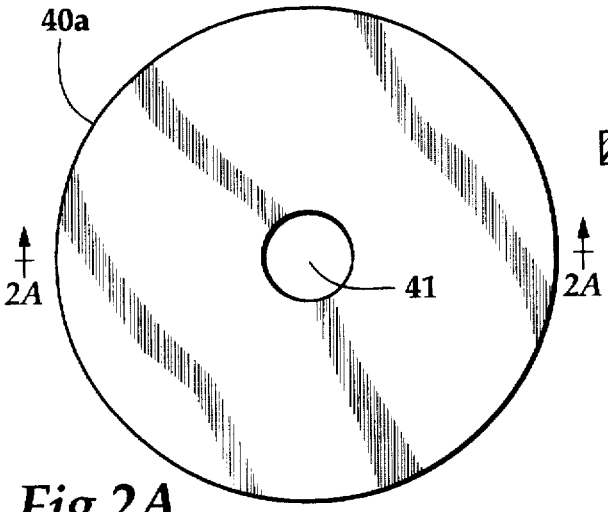

FIG. 2*a* shows a top view of a stabilizing disk having two planar surfaces.

Figure 2B:
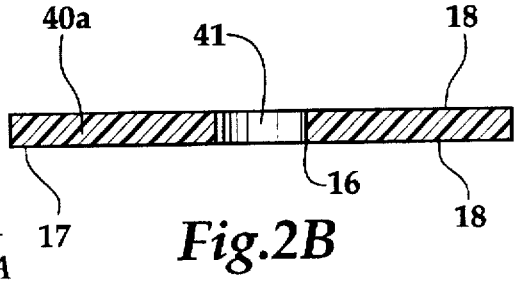

FIG. 2*b* shows a lateral view of a portion of the disk illustrated in FIG. 2*a*.

Figure 2C:
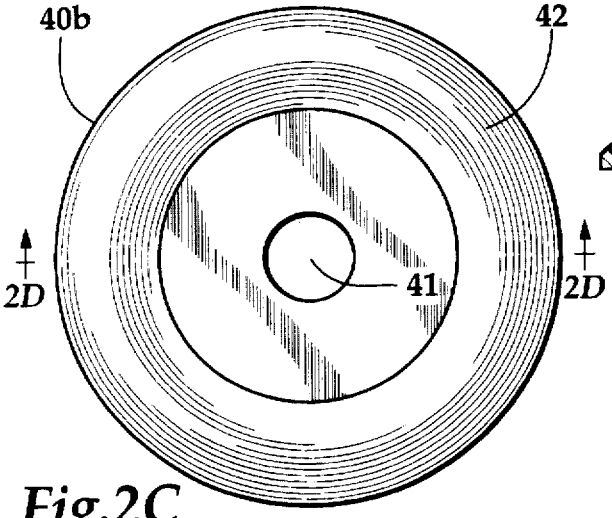

FIG. 2*c* shows a top view of a stabilizing disk having at least one planar surface and a peripheral circular rim on one surface.

Figure 2D:
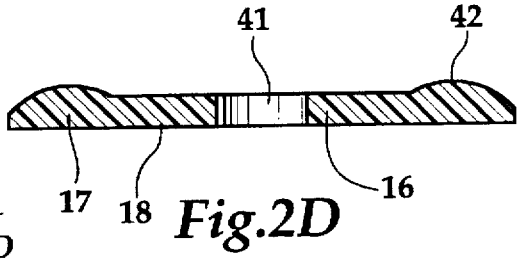

FIG. 2*d* shows a lateral view of a portion of the disk illustrated in FIG. 2*c*.

Figure 2E:
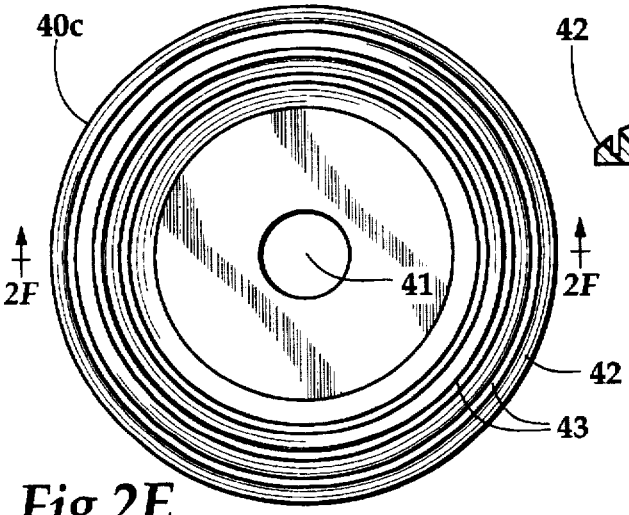

FIG. 2*e* shows a top view of a stabilizing disk having at least one planar surface and a circular peripheral rim, the peripheral rim further having at least one circular groove therein.

Figure 2F:
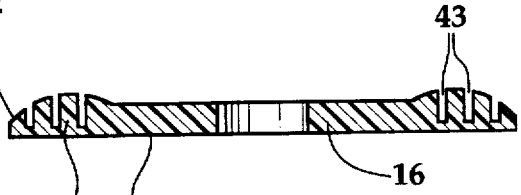

FIG. 2*f* shows a lateral view of a portion of the stabilizing disk illustrated in FIG. 2*e*.

Figure 3A:
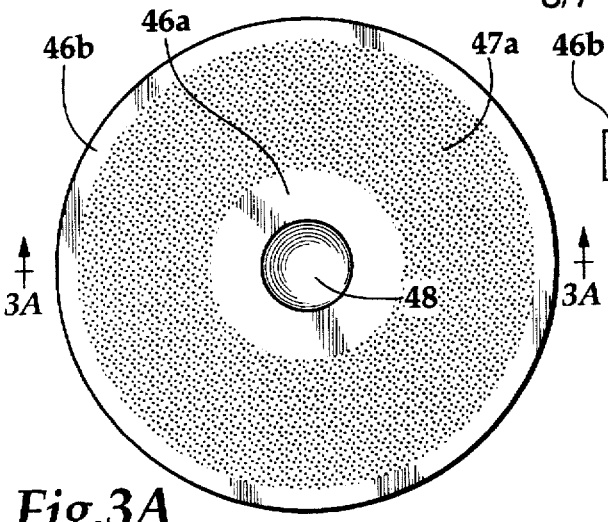
Figure 3B:
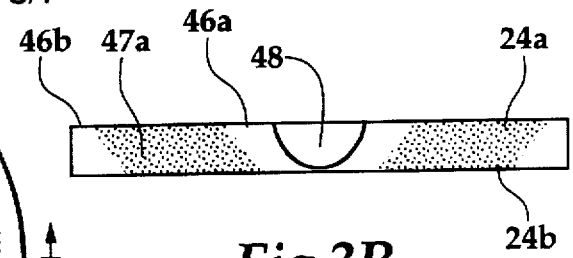

FIGS. 3*a* and 3*b* show a top-view and cross-sectional view of an adjusting disk having inner and outer non-porous regions and an intermediate porous region having microscopic pores.

Figure 3C:
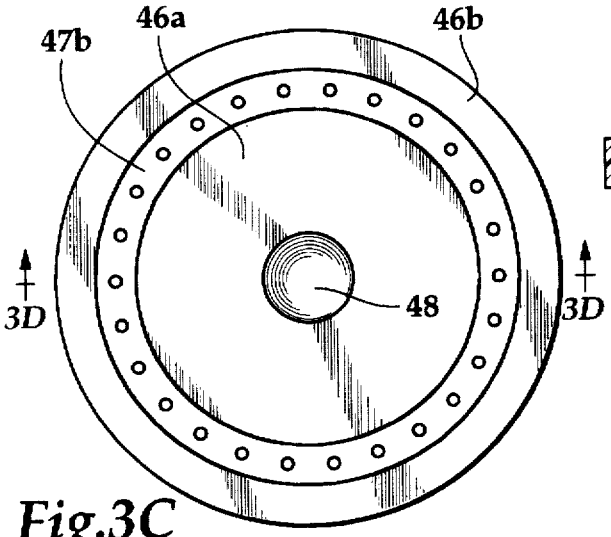
Figure 3D:
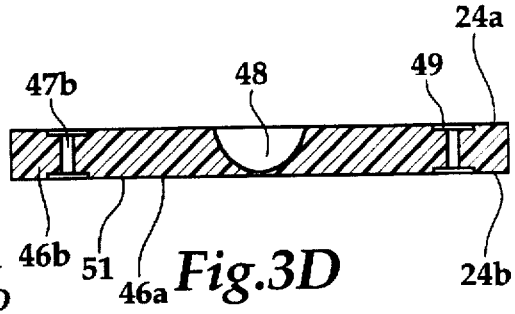
Figure 3E:
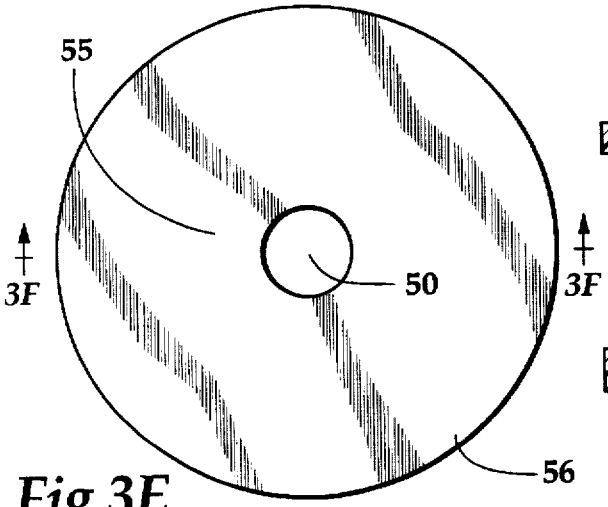

FIGS. 3*e* and 3*d* show a top-view and cross-sectional view of an adjusting disk having inner and outer non-porous regions and an intermediate porous region having macroscopic channels or pores.

Figure 3F:
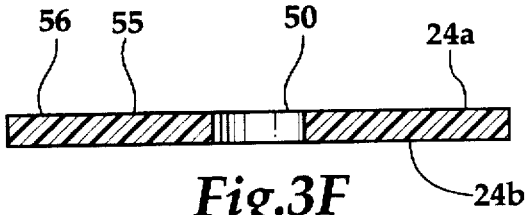

FIGS. 3*e* and 3*f* show a top-view and cross sectional view of an adjusting disk having no porous channels.

Figure 3G:
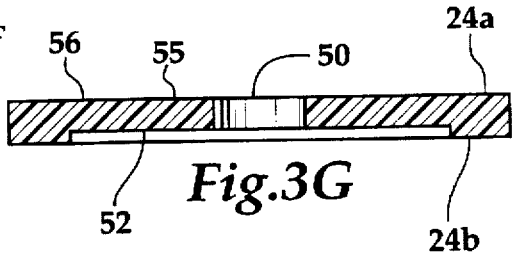

FIG. 3*g* shows a cross sectional view of a variation of the adjusting disk illustrated in FIG. 3*e*.

Figure 4A:
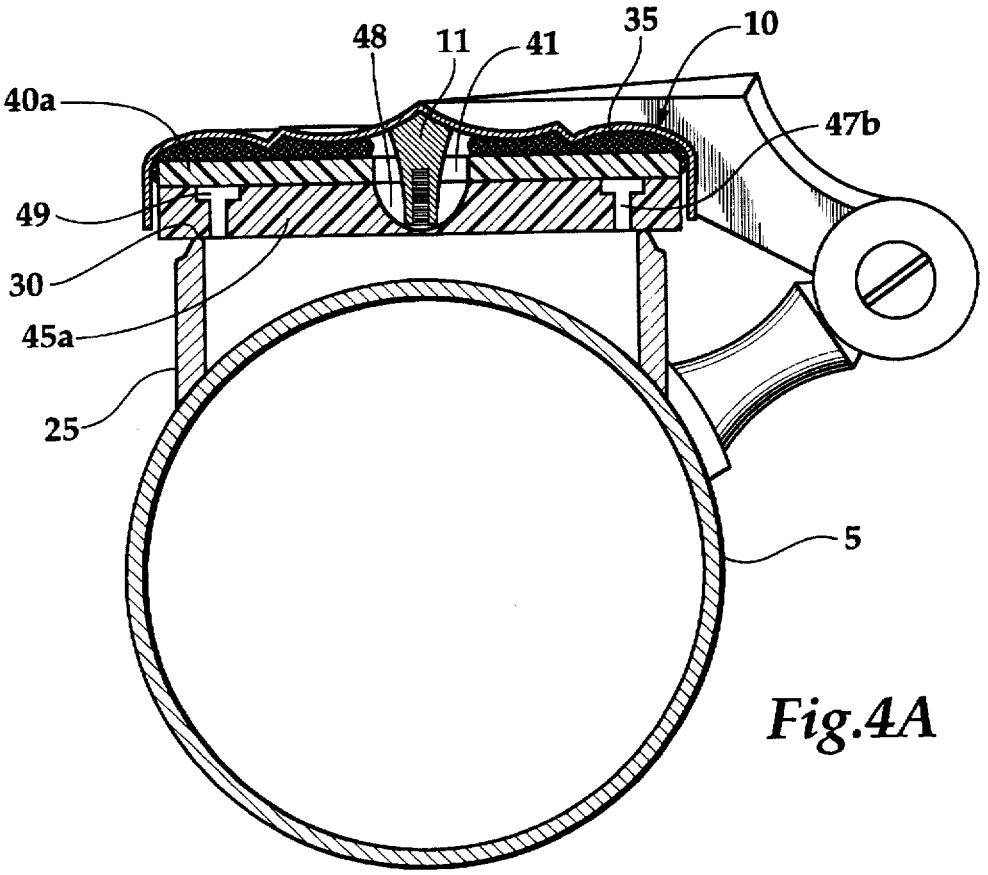
Figure 4B:
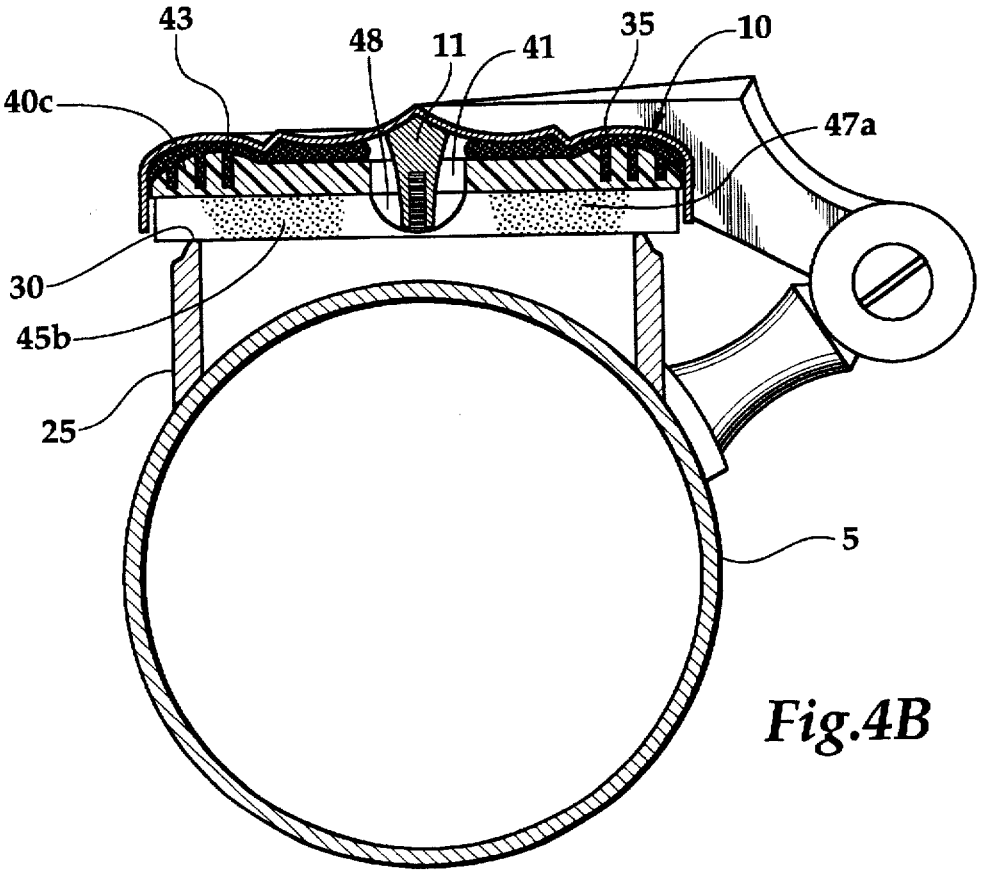

FIGS. 4*a* and 4*b* each show longitudinal sections of a closed hole pad cup containing a layer of adhesive, a stabilizing disk, and adjusting disks in place over a tone hole positioned for adjustment with a vacuum.

Figure 5A:
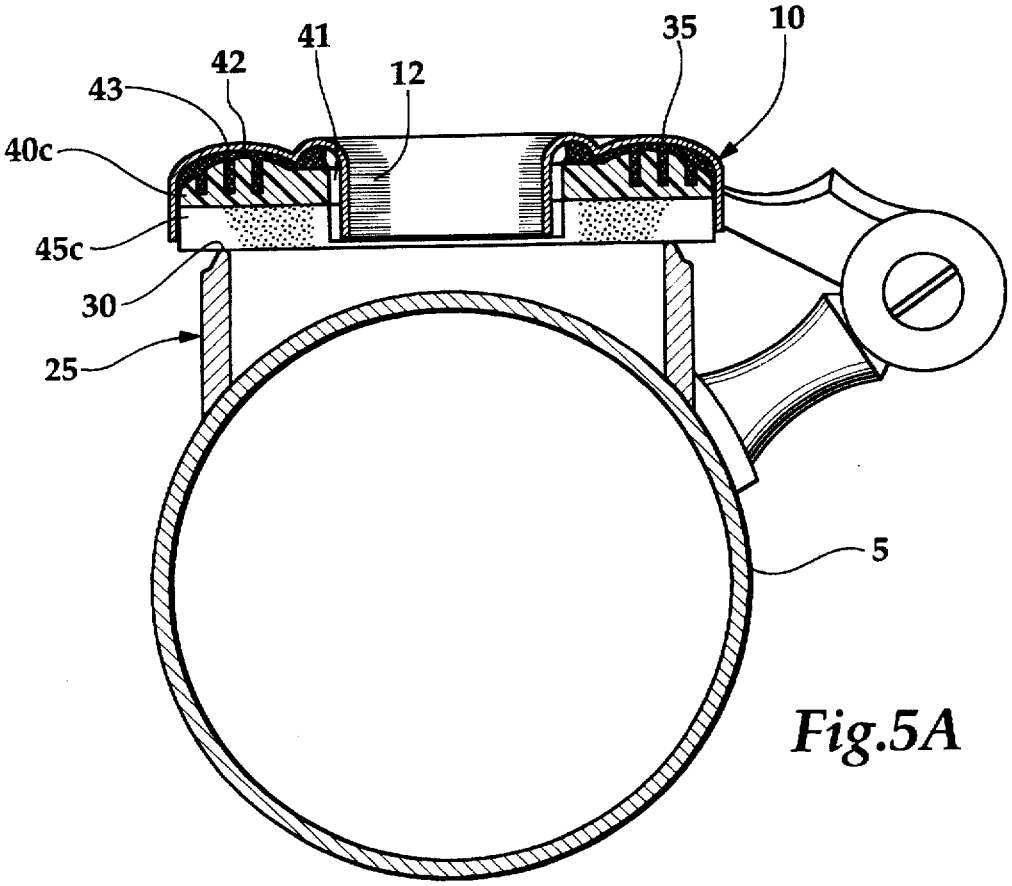
Figure 5B:
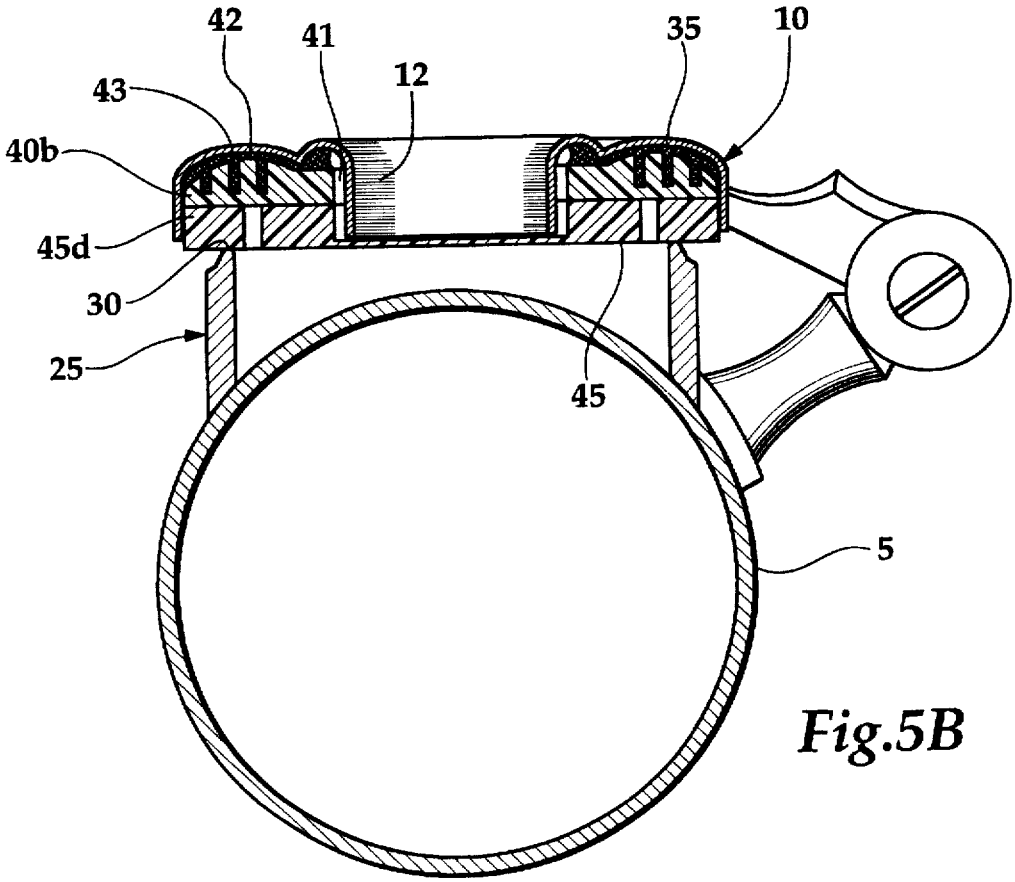

FIG. 5*a* and 5*b* show longitudinal sections of an open hole pad cup containing a layer of adhesive, a stabilizing disk, and adjusting disks in place over a tone hole positioned for adjustment with a vacuum.

Figure 6:
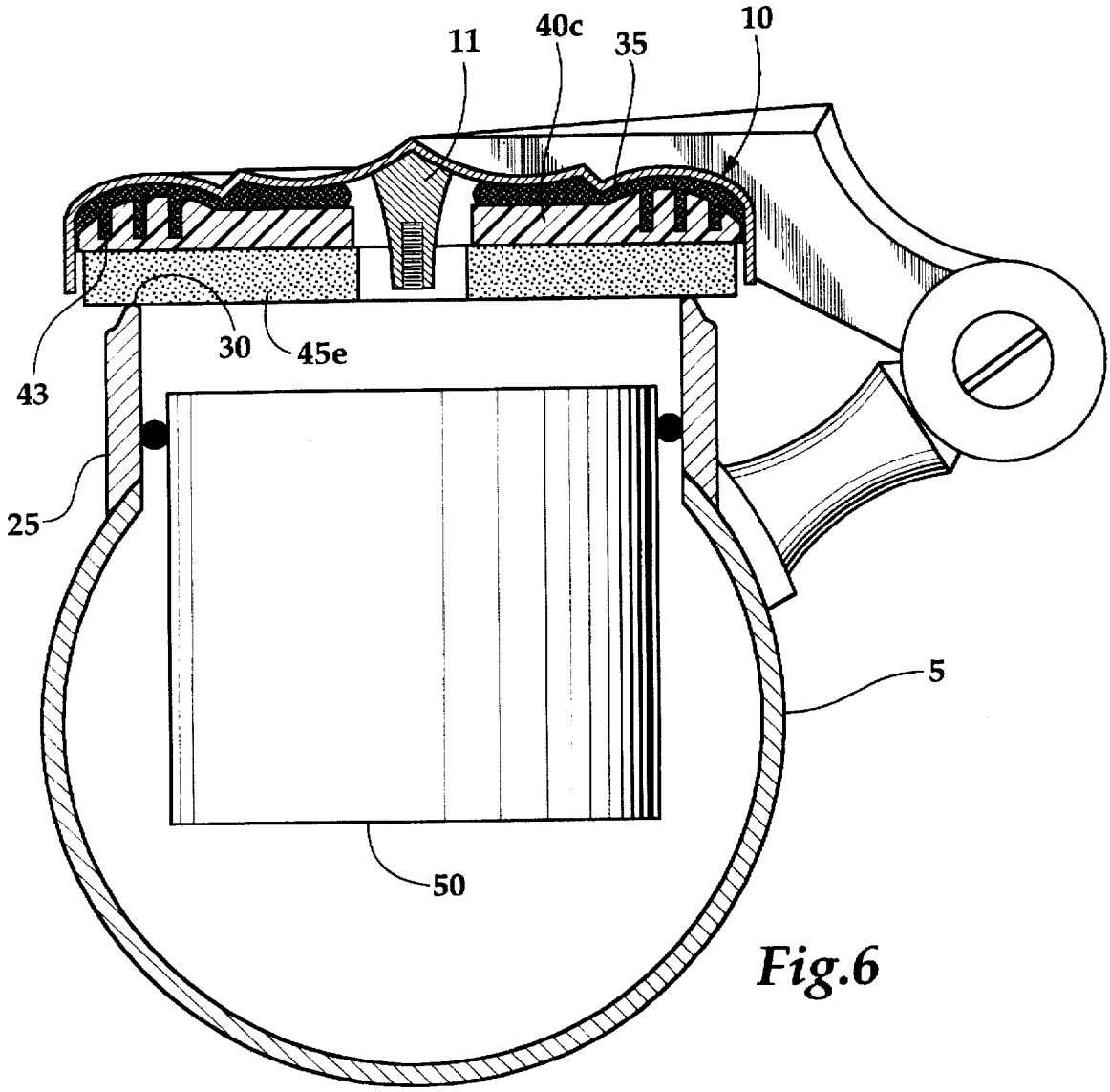

FIG. 6 shows longitudinal sections of a closed hole pad cup containing a layer of an adjusting agent, a magnetically attractable stabilizing disk, and an adjusting disk assembled for pad adjustment with a magnet.

Figure 7A:
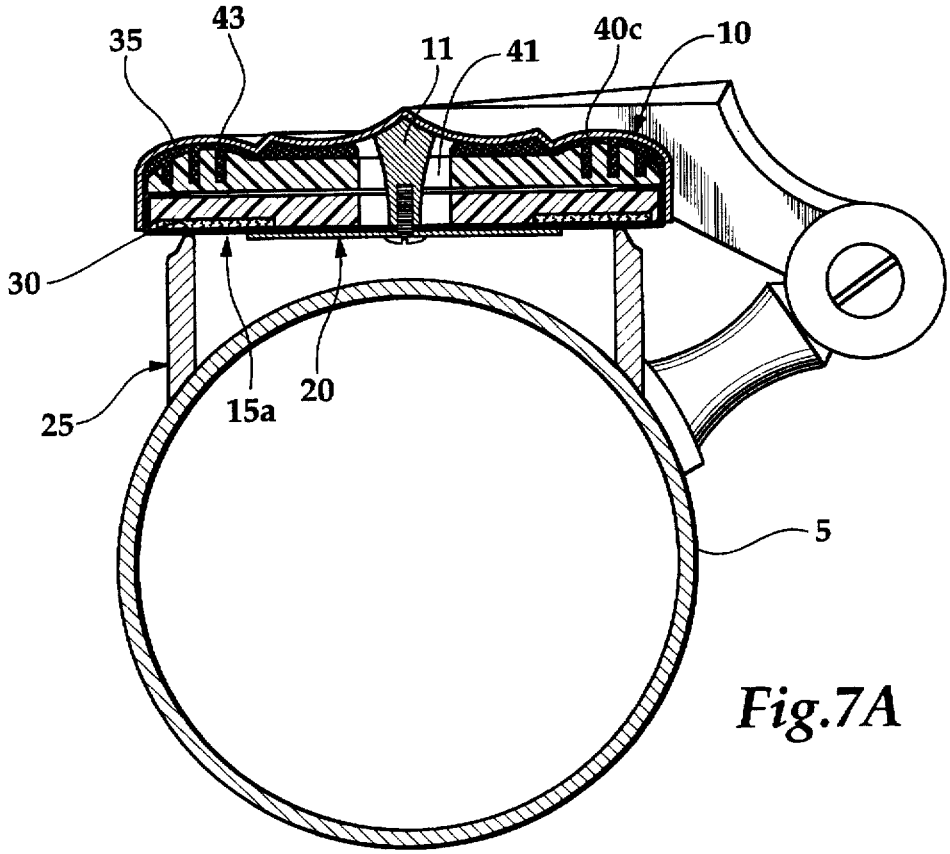
Figure 7B:
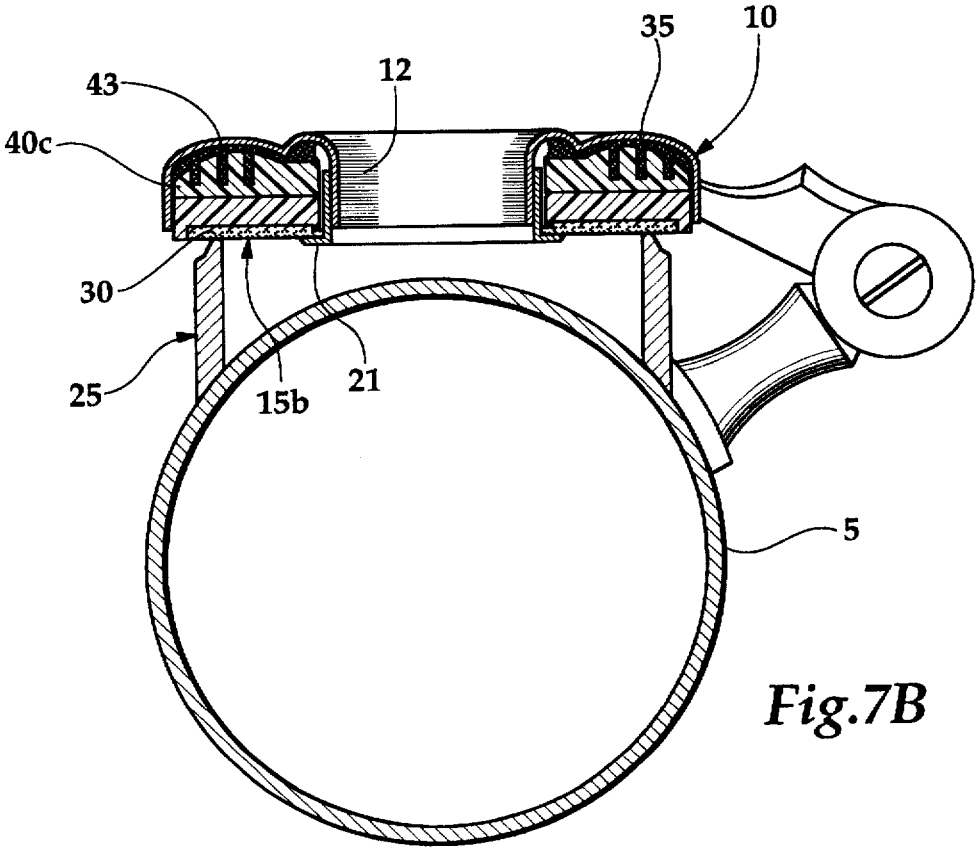

FIG. 7*a* and 7*b* show longitudinal sections of closed and open tone hole covering assemblies after adjustment, removal of the adjusting disk, and installation of the pad assembly.

DESCRIPTION

For the purposes of promoting an understanding of the principles of this invention, reference will now be made to several embodiments and specific language will be used to describe the same. It will nevertheless be understood that no limitation of the scope of the invention is thereby intended, such alterations and further modifications and applications of the principles of the invention as described herein being contemplated as would normally occur to one skilled in the art to which the invention relates.

This invention relates to novel stabilizing disks, novel adjusting disks and a method for adjusting flute pad assemblies utilizing these novel disks. Embodiments of this invention are applicable to both the closed tone hole covering assemblies and the open (French) tone hole covering assemblies. Conventional tone hole covering assemblies are composed of several components described in detail below. As used herein, the term pad cup refers to a shallow cylindrical cup having cylindrical walls and an endplate attached to one side. Closed hole assemblies have a solid endplate and a pad nut or short column centrally located within the pad cup and attached to the endplate. The endplate for an open hole assembly has a central cavity with a chimney, or short cylindrical column within the pad cup, attached to the endplate and centrally located so that cavities within the chimney and the endplate form a continuous region.

The pad assembly is composed of a backing disk and cushion layer covered by one or more layers of a sealing skin and is held within the pad cup by a retainer. The term retainer refers to either a washer and fastener combination having means for attaching the fastener to the pad nut and retaining the pad assembly within the closed hole pad cup or a friction held collar utilized for retaining the pad assembly within the open hole pad cup. Means for attaching the retainer's fastener to the pad nut include a) a threaded shaft sized to fit within a threaded cavity centrally located within the pad nut, b) a flanged shaft utilizing slide slits to allow for compression of the flanged region for insertion into a flanged cavity centrally located within the pad nut, and c) a ball and socket arrangement involving either a ball located on the fastener's shaft and a socket centrally located within the pad nut or a socket located at the end of the fastener's shaft and a ball located centrally on the tip of a modified pad nut opposite the endplate.

The term "first side" utilized in referring to specific sides of a stabilizing disk, an adjusting disk, or a pad assembly, refers to the side of the structure facing the pad cup's endplate when the components are assembled for pad adjustment or after pad adjustment when the pad assembly has been installed. The term "second side" similarly refers to the side of a structure facing opposite the pad cup's endplate in an assembled or partially assembled structure.

The term "generally planar" refers to surfaces which are either actually planar or which would be planar but for the removal of portions of the surface. The second side of the adjusting disk illustrated in FIG. 3*g* illustrates the latter example of a surface which is "generally planar" wherein the presence of a circular void 52 prevents the disk's second surface from being entirely planar.

The stabilizing disk is a washer-shaped disk having at least one planar surface, an opening within the disk's central region sufficiently large to fit over the central pad nut or chimney and having a region located at or near the disk's circumference which can deflect sufficiently to conform the surface of its second side to the contour of the tone hole surface. Sufficient flexibility can be achieved by controlling the disk's thickness or by locating one or more circular grooves within one or both surfaces intermediate or at the disk's periphery. The stabilizing disk can be made of metal, a polymeric material, or a combination of these materials. Stabilizing disks made from polymeric materials can be cuts machined, or molded from stock materials. One embodiment of the stabilizing disk has at least some magnetic properties, a second embodiment has an annular peripheral rim opposite the disk's planar surfaces and a third embodiment has circular grooves within the disk's outer region.

The stabilizing disk is positioned within the pad cup by an adjusting agent capable of flowing during the adjusting process and subsequently solidifying to position the stabilizing disk in an adjusted position. The adjusting agent comprises conventional adhesives able to bond with surfaces contacted and alternatively, materials capable of first existing in a fluid state and finally after adjustment, solidifying without significant adhesion to surfaces contacted. The adjusting disk is a circular disk sized and shaped to fit into the pad cup in place of the pad assembly during the adjusting process and sufficiently flexible to be capable of conforming to the contour of the tone hole surface. The adjusting disk's first side has a central depressed region of sufficient size to allow the adjusting disk to fit over the pad cup's pad nut or chimney during the adjusting process. One preferred embodiment of the adjusting disk has a porous region intermediate between central and outer non-porous regions, the channels within the porous region connecting the disk's first and second sides. The non-porous regions have surfaces capable of forming a seal when in contact with the tone hole surface and the stabilizing disk's second side. The adjusting disk can be constructed of a single material, a combination of materials, or laminated as will be illustrated.

The adjusting process requires placing of an adjusting agent, a stabilizing disk, and an adjusting disk within a pad cup; applying continued and sufficient pressure to the pad cup assembly to cause the adjusting disk's second surface to contact the instrument's tone hole surface; and exerting a downward force on the stabilizing disk/adjusting disk combination. The downward force can result from a magnetic force or a vacuum emanating from within the instrument through the tone hole region. While the adjusting agent is maintained in a fluid state, the downward force causes the stabilizing disk and adjusting disk combination to conform to the tone hole surface. Once the two disks have conformed to the tone hole surface, the downward force is maintained until the adjusting agent has solidified, locking the stabilizing disk into an adjusted position. Finally, pressure is removed from the pad cup assembly, the downward force is removed and the adjusting disk is replaced with a pad assembly having the same uniform thickness as the adjusting disk measured at the pad and tone hole interface.

A more detailed description of the invention follows and refers to the appended drawings. FIG. 1 shows the relationship between the adjusted pad assembly 15 and the tone hole 25 mounted on the body of a flute 5 wherein the pad cup 10 containing the pad assembly is mounted over the tone hole 25 so that pressure on either the pad or a key that controls the pad causes the pad to close forming a seal between the surface of the pad assembly and the tone hole surface 30. The stabilizing disk 40 has a grooved peripheral rim 42 on the disk's first side.

FIGS. 2*a* through 2*f* illustrate different embodiments and views of the novel stabilizing disk made by machining, cutting, or molding the stock materials described below to the appropriate shape and dimensions. As illustrated, the disks have a central region 16 surrounding a cavity 41, an outer flexible region 17 and at least one planar surface 18. A rim 42 located at the outer circumference on the disk's first surface reduces leakage of the adjusting agent during the adjusting process. To impart additional flexibility, one or more grooves 43 can be cut at any location on the disk's first side, preferably near the outer circumference, or on the disk's second surface in the region that will lie opposite the porous region of the adjusting disk's first side during the adjusting process.

FIGS. 2*a* and 2*b* illustrate a stabilizing disk 40*a* having two planar surfaces 18 and central opening 41. Although materials of construction can include both metals and polymeric materials, a stabilizing disk 40*a* constructed from spring steel having a thickness ranging from 0.002 to 0.020 of an inch and more preferably between 0.005 to 0.010 of an inch has been preferred.

FIGS. 2*c* and 2*d* illustrate a stabilizing disk 40*b* having at least one planar surface 18, a central opening 41 within the central region 16, and a peripheral rim 42 on the disk's outer flexible region 17 and on the disk's first surface. Materials of construction can include metal, polymeric materials, or combinations of metal and polymeric materials. For example, a peripheral rim of steel can be bonded to the first side of a planar disk made of "DELRIN", a peripheral rim of polypropylene can be bonded to the first side of a spring steel planar disk, or small particles of metal can be added to molten polymer prior to extrusion, molding, and machining to form the stabilizing disk. Specific materials of construction utilized include spring steel "DELRIN", polypropylene, polyethylene, polycarbonate, and polytetrafluoroethylene.

Based on initial studies the stabilizing disk 40*b* manufactured from "DELRIN", a polyoxymethylene (acetal) available from the Ensinger Corporation, 265 Meadowlands Blvd., Washington, Pa. 15301, is preferred. Additional information regarding the polyoxymethylene (acetal) utilized can be found in ASTM Specifications, D-4181-92a, POM111. "DELRIN" is a registered trademark of E. I. du Pont de Nemours & Company, Wilmington, Del. 19898. The disk 40*b* is sized to fit into the pad cup closely to minimize leakage of the adjusting agent and with a thickness measured at the rim between 0.010 to 0.090 of an inch and preferably between 0.025 to 0.045 of an inch. Stabilizing disks having the broader range of thickness are required when tone holes vary widely from planarity. Stabilizing disk 40*b* made according to the same dimensions from polypropylene, polyethylene, polycarbonate, and polytetrafluoroethylene performed similarly. FIGS. 2*e* and 2*f* show views of a the stabilizing disk 40*c* having a further modification wherein the peripheral rim 42 has one or more grooves 43 cut into the circular rim to further improve flexibility of the pad interfacing side of the disk and to improve bonding with the adjusting agent. Although the number of grooves, their width, and their depth are not critical to the performance of the stabilizing disk, initial trials with three (3) grooves having a width of 0.020 an inch and a depth at least the height of the rim have demonstrated improved flexibility and an improved ability to bond with an adjusting agent over a similar disk without the circular grooves. In addition, solidified adjusting agent within the grooves of an adjusted stabilizing disk prevented flexing of the disk as it attempted to resume its original shape and as a result reduced the adjusted disk's tendency to pull away from the solidified adjusting agent.

FIGS. 3*a*, 3*b*, 3*c* and 3*d* illustrate different views of embodiments of the novel adjusting disk designed to be adjusted with a downward force derived from a vacuum emanating from the interior of the instrument, the adjusting disks having central nonporous regions 46*a*, an intermediate porous regions 47*a* or 47*b*, an outer nonporous region 46*b* and a central depressed region 48 on its first side within it's inner nonporous region. The nonporous regions 46*a* and 46*b* are capable of forming a seal with the smooth planar surface of a stabilizing disk.

The porous region 47*a* illustrated in FIGS. 3*a* and 3*b* is composed of sintered material commonly used as a filtration medium. Suitable sintered materials include but are not limited to sintered glass, polypropylene, polyethylene and polytetrafluoroethylene. Sintered polypropylene and polyethylene can be obtained from Porex Technologies, 500 Bekannon Road, Fairburn, Ga. 30213.

The porous region 47*b* in FIGS. 3*c* and 3*d* was made by cutting or drilling a circular pattern of channels in a nonporous material such as neoprene rubber laminated with spring steel as illustrated. Although the size and shape of the channels are not critical to the disk's performance, circular channels ranging from 0.200 to 0.800 of an inch in diameter or more preferably from 0.600 to 0.750 of an inch in diameter are preferred. A surface channel 49 located on the adjusting disk's first side within the porous region is not essential to the adjusting disk's performance, but improves the seal produced between the stabilizing and adjusting disks during the adjusting process by increasing the surface of the stabilizing disk's second side in contact with the vacuum during adjustment and increases the disk's flexibility. When present, the surface channel should have a depth of from 0.001 to 0.010 of an inch and more preferably from 0.003 to 0.005 of an inch with a width from ¼ to five (5) times the diameter of the channels connecting the two sides of the disk and more preferably ½ to one (1) times the diameter of the same channels. The latter narrower range for the channel's depth and width provides for the optimum sealing surface in contact with the stabilizing disk and results in an adjusting disk with optimum flexibility. Surface channels can also be utilized in the adjusting disk illustrated in FIGS. 3*a* and 3*b* although with less improvement of the seal. The rough textured surface of the porous region of the disk illustrated in FIGS. 3*a* and 3*b* utilizing a sintered material causes the entire porous region to behave as a surface channel.

The adjusting disk illustrated in FIGS. 3*a* and 3*b* was constructed from an appropriate sized sintered disk by first cutting, machining, or melting a central depression 48 on the disk's first side. The thickness of a polypropylene disk can be altered, if necessary, by heating the modified sintered disk and compressing it to the desired thickness. Care should be taken to avoid overheating and collapsing the microscopic pores within the porous region of the sintered material. Non-porous regions 46*a* and 46*b* were then made by rubbing a flexible non-porous material such as silicone rubber adhesive into the pores of the sintered material in appropriate regions and allowing the non-porous material to cure. Similar adjusting disks were also made by gluing inner and outer non-porous sections 46 to an appropriately sized intermediate porous section 47*a* cut from a porous disk. However, these adjusting disks had a greater tendency to develop leaks at the glue joints. Although the adjusting disk illustrated in FIGS. 3*a* and 3*b* is designed to be used with a vacuum in the adjusting process the disk can also be used with a magnet for the adjusting process.

The adjusting disk illustrated in FIGS. 3*c* and 3*d* having planar surfaces 24*a* and 24*b* was constructed by first cutting the central depression 48 and surface channel 49 in the first side of a circular disk made of a hard rubber material such as neoprene, or a polymeric material such as polypropylene, polyethylene, polycarbonate, "DELRIN", or polytetrafluoroethylene. A thin layer of a polished metal 51 was glued to the disk's second surface and channels 47*b* were drilled through both the rubber and metal in a circular pattern within the surface channel 49. Although any polished metal can be used, spring steel has proven especially suitable and easy to work with and has demonstrated a good degree of flexibility. The thickness of the adjusting disk illustrated in FIGS. 3*c* and 3*d* can be controlled by slightly under-sizing the thickness of the disk components and utilizing excess adhesive forced out with a press having a cavity of the desired thickness. Adjusting disks made from polytetrafluoroethylene required treatment of the polytetrafluoroethylene disk with a sodium emulsion in toluene prior to attachment of the metal disk with glue or prior to any other fabrication which required gluing. Failure to treat the polytetrafluoroethylene surface resulted in poor or failed adhesion. Adjusting disks made from the less compressible polymers such as polypropylene, polyethylene, and polytetrafluoroethylene did not require attachment of a layer of metal to the disk's second side. The adjusting disk illustrated in FIGS. 3*c* and 3*d* is designed to be used with a vacuum but can also be used with a magnet for the adjusting process.

FIGS. 3*e* and 3*f* illustrate views of an adjusting disk without a porous region but having (a) a central region 55 with a more central depression or cavity 50 to contain the pad nut or cylindrical column attached to the pad cup's endplate, (b) an outer flexible region 56, and (c) generally planar surfaces 24*a* and 24*b*. FIG. 3*g* illustrates a cross-sectional view of an adjusting disk wherein the generally planar surface 24*b* has a centrally located circular void 52. The adjusting disk illustrated in FIGS. 3*e*, 3*f* or 3*g* can be used to adjust the pad assembly in conjunction with a stabilizing disk having some magnetic properties and with a magnet exerting the downward force on the stabilizing disk/adjusting disk combination. The adjusting disk is preferably made from a polymeric material capable of resisting compression when forced against the tone hole but having sufficient flexibility to conform to the tone hole by twisting out of its normal plane.

The thickness of adjusting disks illustrated in FIGS. 3*a*, 3*b*, 3*c*, 3*d*, 3*e*, 3*f* and 3*g* measured at the region in contact with the tone hole should correspond to the thickness of the pad assembly which will be installed after the adjusting process has been completed. Adjusting disks utilized for subsequent installation of the preferred pads described in U.S. Pat. No. 4,704,939 are from 0.030 to 0.100 of an inch thick or more preferably from 0.060 to 0.075 of an inch thick. This latter range corresponds to the thickness of pad assemblies more commonly used.

The adjusting process is carried out by a) placing within a pad cup, in contact with the endplate, a layer of adjusting agent capable of flowing during the adjusting process and subsequently solidifying; b) placing a stabilizing disk within the pad cup its first surface in contact with the adjusting agent; c) placing an adjusting disk within the pad cup, its first side in contact with the stabilizing disk; d) attaching the pad cup to the flute, positioned over the tone hole; e) applying and maintaining sufficient pressure on the pad cup to cause the adjusting disk within the pad cup to contact the tone hole surface; f) exerting a downward force on the stabilizing disk/adjusting disk combination, the downward force sufficient to cause the two disks to conform to the contour of the tone hole surface; g) maintaining the downward force until the adjusting agent layer solidifies, holding the adjusting and stabilizing disks in the adjusted positions; h) withdrawing the downward force; i) relieving pressure on the pad cup; j) removing the adjusting disk; and k) installing a pad assembly within the pad cup. Some variation in the order of steps a through k does not affect the adjusting process and is contemplated. For example, step d) can precede steps a through c) without affecting the final adjustment. Similarly, the adjusting agent can be applied to the stabilizing disk's first side and the combination placed within the pad cup simultaneously. Other variations in the order of steps a through k as would be apparent to a skilled artisan are considered within the adjusting process disclosed and claimed. The downward force exerted in step f) above can be derived from a vacuum created within the interior of the instrument or a magnetic field emanating from within the instrument.

FIGS. 4*a* and 4*b* illustrate closed hole assemblies prepared for adjustment. The pad cup 10 with pad nut 11 contains a layer of adjusting agent 35, a stabilizing disk 40*a*, and an adjusting disks 45*a* and 45*b* in contact with the tone hole surface 30. Similarly, FIGS. 5*a* and 5*b* illustrate open hole assemblies prepared for adjustment. During the adjustment process a vacuum is maintained within the flute in the region where the tone hole is located. Individual pads can be adjusted by using internal plugs to isolate the vacuum within the desired region, or all of the pad assemblies on an instrument can be adjusted simultaneously.

For the adjustment to occur, the vacuum should be at least sufficient to conform the stabilizing disk and adjusting disk combination to the contour of the tone hole. This minimum vacuum will vary depending on the design, thickness, and materials used to construct the two disks, and the variance of the tone hole surface from planarity. For the stabilizing disk illustrated in FIG. 2*f*, constructed from "DELRIN" and having a thickness measured at the rim of 0.035 of an inch and the adjusting disk illustrated in FIGS. 3*a* and 3*b* constructed of sintered polypropylene and having a thickness of 0.065 of an inch, a vacuum of about 7 psi and more preferably about 6 psi was generally sufficient to effect adjustment. The lower vacuum proved sufficient when the tone hole varied little from planarity. A similar vacuum was sufficient when the stabilizing disk illustrated in FIG. 3*c* constructed of neoprene and spring steel was used with the same "DELRIN" stabilizing disk. It is contemplated, however, that with more flexible materials, lower vacuums will be adequate, and such modifications are considered within the invention being disclosed and claimed. Higher vacuums were needed for adjustments utilizing less flexible stabilizing disks and adjusting disks and for making adjustments over tone holes varying significantly from planarity. The highest vacuum employed for pad adjustment is limited by the ability of the flute's tube to withstand the vacuum without distortion and the compressibility of the adjusting disk. Compensation for compressibility of the adjusting disk can be made by oversizing the disk's thickness by the amount of compression at the vacuum used for the adjustment. For platinum flutes, vacuums higher than 1 psi have been successfully used to adjust the flute's pad assembly without tube distortion.

The adjusting agent layer 35 can be a conventional one or two-component adhesive that cures at ambient or elevated temperatures over a period of at least several minutes to allow for the adjustment process to occur or can be a hot melt adhesive. One-component adhesives utilized which are capable of curing at ambient temperature include "SILICONE II", a 100% silicone rubber (Methoxypolydimethylsiloxane) manufactured by General Electric Company, Waterford, N.Y. 12188; "STIX-ALL®" a silicone elastomer manufactured by Borden Inc. HHPG, Columbus, Ohio 43215; "BONDINI" Everything Gel and BONDINI™ 2, cyanoacrylate esters manufactured by PROTEL, INC. Santa Monica, Calif. 90401. Rapid curing two-component adhesives include epoxy systems such as "Plastic Welder®" manufactured by the Devcon Corporation, Wood Dale, Ill. 60191, "5 Minute Epoxy" manufactured by Devcon Corporation, Danvers, Mass. 01923 or "Foxy poxy®" manufactured by Crazy Glue Inc., New York, N.Y. 10010. Slower curing conventional two-component epoxy adhesives can be utilized at elevated temperatures as high as 100° C. to shorten the cure time.

Hot melt adhesives are available which soften and flow at a variety of temperatures. The preferred hot melt adhesive should not soften appreciably below about 50° C. When using a hot melt adhesive, the pad cup and its contents must be maintained at a temperature sufficient to allow the adhesive to flow for several minutes to allow the adjustment process to occur and then cooled causing the hot melt adhesive to solidify locking the stabilizing disk into the adjusted position.

Heat to soften the adhesive can be applied to the pad cup and its contents using resistant heating such as a soldering iron, a heat gun generating hot air or the entire assembly can be placed in a heated chamber. A temperature ranging from 60° to 130° C. and more preferably from 75° to 110° C. is generally sufficient when using an ethylvinyl acetate hot melt adhesive available from the Arrow Fastener Company, Inc., 271 Mayhill Street, Saddle Brook, N.J. 07662.

FIG. 6 illustrates a closed hole assembly containing an adjusting agent 35, a stabilizing disk 40*c*, and an adjusting disk 45*e* in position for pad adjustment wherein the downward force exerted on the stabilizing disk/adjusting disk combination results from a magnet 50 placed within the instrument. Adjusting disks designed to be used with a vacuum are also suitable for use with a magnet if a stabilizing disk comprising at least some metal is used. The magnet used for adjustment can be a permanent or an electromagnet as described in U.S. Pat. No. 5,297,465, the disclosure of which is hereby incorporated by reference.

FIGS. 7*a* and 7*b* illustrate closed and open hole assemblies after alignment and replacement of the adjusting disk 45 with a pad assemblies 15*a* and 15*b* having the same thickness as the adjusting disk used for the adjusting process. The pad assemblies are held in place by retainers 20 and 21.

Pad adjustments made with the novel stabilizing disks and adjusting disks utilizing the novel method disclosed provide for rapid and accurate adjustment of a flutes pads previously unattainable. If warranted, further adjustment using paper shims or other conventional methods can be used. Although the drawings combine specific features of the invention for the purpose of illustration, no limitation is intended and it is anticipated that the various features can be combined in ways not illustrated but which are still within the scope of the invention disclosed and claimed below.

I claim:

1. A method for seating a woodwind instrument's pad assembly within a pad cup so that the pad assembly evenly contacts a tone hole surface, the method comprising the steps of:

(a) placing an adjusting agent within the pad cup in contact with an endplate of the pad cup;

(b) placing a stabilizing disk within the pad cup in contact with the adjusting agent;

(c) inserting an adjusting disk within the pad cup in contact with the stabilizing disk;

(d) attaching the pad cup to a flute wherein the cup is positioned over a tone hole;

(e) applying and maintaining pressure to the pad cup and its contents sufficient to cause the adjusting disk to impact with the tone hole surface;

(f) applying sufficient downward force on the stabilizing disk to cause the stabilizing disk and the adjusting disk to conform to the tone hole surface;

(g) maintaining the force for a time sufficient for the adjusting agent to become firm and to secure the stabilizing disk in the adjusted position;

(h) replacing the adjusting disk with the pad assembly.

2. A method as described in claim 1, wherein said stabilizing disk has at least some ability to be attracted by a magnet and said applying sufficient downward force includes creating a magnetic force capable of interacting with the stabilizing disk.

3. A method as described in claim 1, wherein said adjusting disk has an intermediate porous region bordered by planar regions capable of forming a seal with both the stabilizing disk and the tone hole and said maintaining includes creating a vacuum within said instrument.

4. A method as recited in claim 3, wherein said adjusting agent is a hot-melt adhesive and said maintaining includes heating said adhesive to an elevated temperature sufficient to soften the adhesive and subsequently cooling said adhesive to a temperature sufficient to harden the adhesive.

5. A method as recited in claim 3, wherein said adjusting agent is a heat curable adhesive, and said maintaining includes heating the adhesive to an elevated temperature for a time sufficient to cause the heat curable adhesive to cure.

6. A method as recited in claim 3, wherein said adjusting agent is an adhesive capable of curing under ambient conditions, and said maintaining is for a time sufficient for the adhesive to cure.

7. A method as recited in claim 3, wherein said placing steps include placing the adjusting agent and the stabilizing disk within the pad cup simultaneously.

8. A method as recited in claim 3, wherein said applying sufficient downward force includes applying the force to more than one stabilizing disk simultaneously.

9. A method as recited in claim 3, wherein said applying sufficient downward force includes creating a vacuum of at least 7 psi within the instrument.

10. A method as recited in claim 3, wherein said adjusting disk has a porous region comprised of microscopic pores.

11. A method as recited in claim 3, wherein said adjusting disk has a porous region comprised of macroscopic pores.

12. A method as recited in claim 3, wherein said pad assembly has a uniform thickness.

* * * * *